US007891471B2

(12) United States Patent
Malachowski

(10) Patent No.: US 7,891,471 B2
(45) Date of Patent: Feb. 22, 2011

(54) BRAKE SYSTEM STABILIZER ASSEMBLY

(76) Inventor: Jerome A. Malachowski, 7507 Zimmerman Rd., Hamburg, NY (US) 14075

( * ) Notice: Subject to any disclaimer, the term of this patent is extended or adjusted under 35 U.S.C. 154(b) by 1168 days.

(21) Appl. No.: 11/528,004

(22) Filed: Sep. 27, 2006

(65) Prior Publication Data

US 2008/0073166 A1 Mar. 27, 2008

(51) Int. Cl.
*F16D 65/14* (2006.01)

(52) U.S. Cl. ..... 188/207; 188/4 R; 188/205 R; 188/206 R

(58) Field of Classification Search ..... 188/205 R, 188/206 R, 207, 209, 212, 213, 219–233
See application file for complete search history.

(56) References Cited

U.S. PATENT DOCUMENTS 2,568,704 A * 9/1951 Baselt ..... 188/206 R
2,874,811 A * 2/1959 Baselt ..... 188/207
2,940,554 A * 6/1960 Cameron ..... 188/153 R
3,040,840 A * 6/1962 Cale ..... 188/52
3,098,545 A * 7/1963 Murphy ..... 188/76
5,058,712 A * 10/1991 Noah ..... 188/59
7,410,037 B2 * 8/2008 De La Fuente-Farias . 188/233.3
7,430,794 B2 * 10/2008 Steffen et al. ..... 29/402.01
2006/0175158 A1 * 8/2006 Zhang ..... 188/218 R

* cited by examiner

*Primary Examiner*—Robert A Siconolfi
*Assistant Examiner*—James K Hsiao

(57) ABSTRACT

The present invention adds a stabilizing force member to prior art Railway brake systems and greatly improves the control of the spatial orientation of a modified brake beam within a Railway vehicle and provides lateral support to a truck lever connection and levers, which in turn, properly locate actuating bars of the brake system. As a result, service life of brake beam support components and brake shoes are extended, brake lever friction is reduced and brake system efficiency is increased.

6 Claims, 3 Drawing Sheets

BRAKE SYSTEM STABILIZER ASSEMBLY

BACKGROUND OF THE INVENTION

Brake Systems-on Railway vehicles employ force transmitting members, including brake beams to provide train braking forces. A primary suspension_means for the brake beams can take the form of end guides located at each end of the brake beam. These are positioned and supported within unit guide wear liners which are, in turn, installed in the railway truck frames. This suspension also acts to react the torque generated by braking, and initially positions and aligns the frictional brake shoes with the wheel tread surfaces in an acceptable manner.

In the prior art, the generated braking torque eventually coerces_the brake shoes away from the desired alignment with the wheel tread surfaces. The brake friction forces often cause severe vibration in the previously mentioned supporting members. These members become worn and distorted. At some point in time, they are no longer able to properly align the brake shoes with the wheels.

Consequently, the worn supporting members of the prior art allow the brake shoes to wear increasingly more at one end than the other. This uneven brake shoe wear requires premature replacement, wherein a considerable amount of brake friction material is resultingly discarded as unusable. Brake shoe maintenance costs are higher than necessary. Other progressive damage also occurs to brake beams, levers and actuating bars of the brake system. The progressive damage causes misalignments, reduces the available braking force and renders the involved train less safe.

SUMMARY OF THE INVENTION

The present invention appends a stabilizing member in an area of the brake system used to transmit applied brake forces from an actuating cylinder to the brake beam. This member greatly improves the control of the spatial orientation of a modified brake beam within a railway vehicle truck and provides lateral support to a truck lever connector and levers, which in turn, properly locate actuating bars of the brake system.

The main object of the present invention is to provide a stabilizer that can be appended to the applied brake force path in_brake rigging assemblies of various railway vehicles to counteract the adverse torque imposed on a brake beam during brake applications. The use of the present invention causes an improved operating alignment between installed brake shoes and the railway vehicle wheels.

A second object of the present invention is to provide a stabilizer that can be appended to the applied brake force path in_brake rigging assemblies of various railway vehicles to provide desired alignment and a resulting low friction interface between end guides of the brake beam and unit guide wear liners installed in the side frames.

A third object of the present invention is to provide a stabilizer that can be appended to the applied brake force path in brake rigging assemblies of various railway vehicles to increase the useful life of railway cars and their wheels by reducing vibration from damaged wheels, as frequently occur when using a prior art support means for the braking system.

A fourth object of the present invention is to provide a stabilizer that can be appended to the applied brake force path in_brake rigging assemblies of various railway vehicles to provide an alignment and operating means for a braking system that uses standard bent brake levers.

It is a further object of the present invention to provide attachment points on brake beams and connectors for appending a stabilizer member to the applied brake force path in brake rigging assemblies of various railway vehicles.

It is a further object of the present invention to provide controlled angular alignment of a connector that is pinned to levers supported in brake beams.

It is yet a further object of the present invention to provide a stabilizer that causes a brake lever to have guided lateral support, which in turn controls the location of a top actuating bar in the applied brake force path.

BRIEF DESCRIPTION OF THE DRAWINGS

The foregoing objects and other advantages of the present invention can be better understood from the following detailed descriptions of the preferred embodiment which, in turn, refer to these drawings.

DETAILED DESCRIPTION OF THE EMBODIMENT

Figure 1:
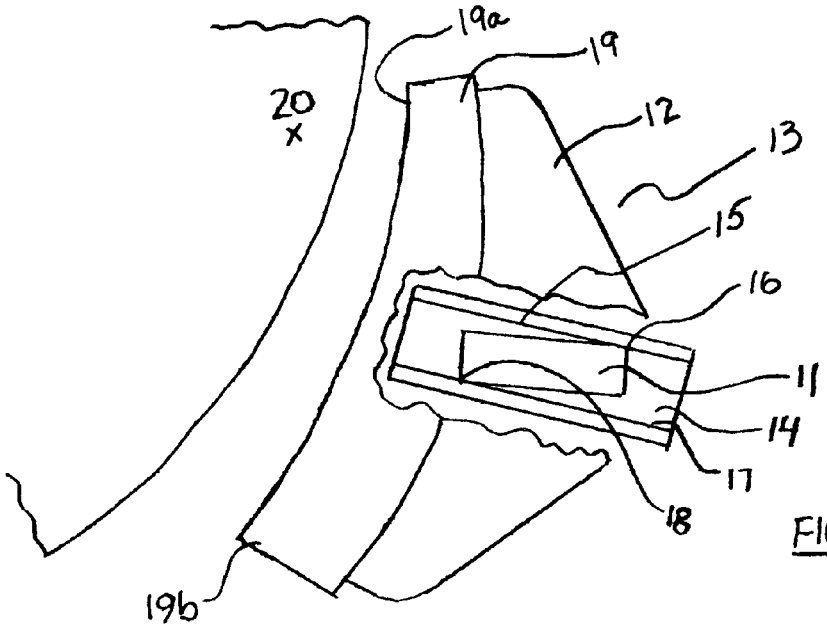
FIG. 1. is a partial elevation of a prior art brake head and end guide of a brake beam, supported and guided within a unit guide wear liner. This sketch demonstrates how misalignment between brake shoes and wheel tread surfaces can possibly occur in the prior art.

In FIG. 1, end guide 11 and brake head 12 are parts of brake beam assembly 13 in the prior art. Brake shoe 19 is installed and fastened in brake head 12. End guide 11 is positioned within upper surface 15 and lower surface 17 of wear liner 14 (visible in the cut-out areas of brake head 12 and brake shoe 19). End guide 11 may make contact with inside surfaces 15 and 17 at corners 16 and 18 when the brakes are applied.

Repeated brake applications may cause end guides 11 and wear liner 14 to wear away at areas 16 and 18. These worn areas allow end guide 11, brake head 12, brake beam assembly 13 and brake shoe 19 to rotate in a counter-clockwise direction as depicted in this figure. In this orientation, wear of brake shoe 19 will be greater in the top area 19*a* compared to bottom area 19*b*. At some point in time, top area 19*a* will wear to the minimum thickness allowed while a large fraction of the brake friction material originally available at bottom area 19*b* still remains. At worst, about half of the original brake friction material may be unusable. This makes it more expensive for the owner of the Railway car to properly maintain the vehicle.

Figure 2:
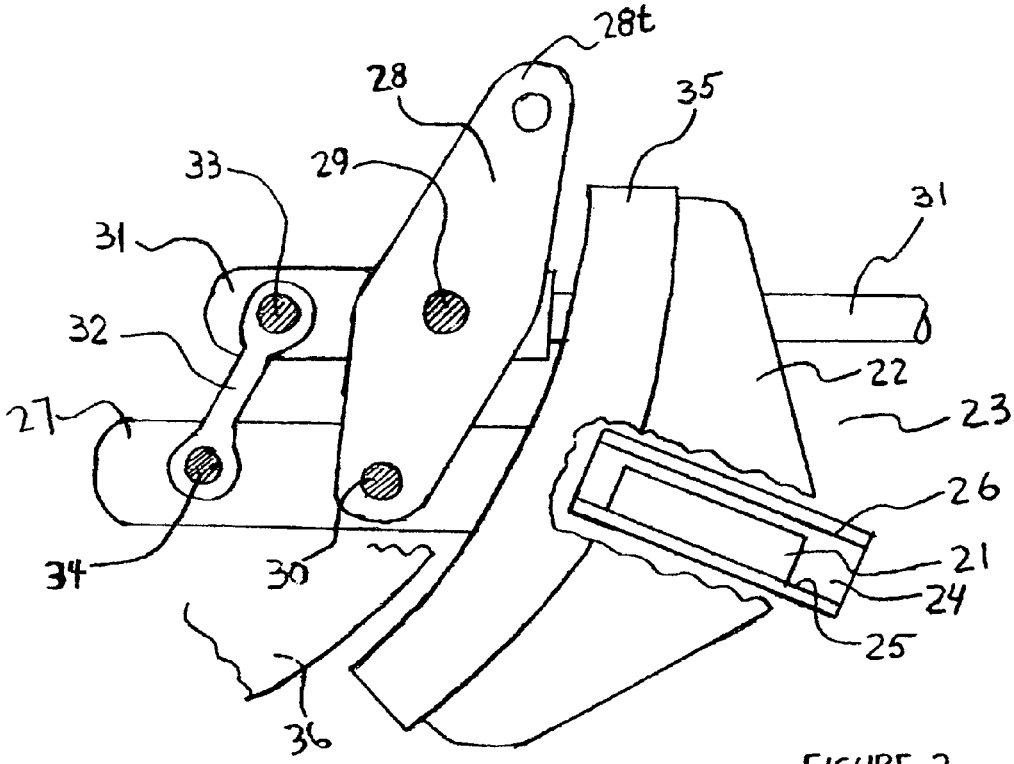
FIG. 2. is a partial elevation view of a Brake Beam stabilizer Assembly of the present invention installed in a Railway car brake system using a connector positioned above the brake beam strut.

In FIG. 2, end guide 21, brake head 22 and strut 27 are components of brake beam assembly 23 of the present invention. Lever 28 is connected by means of pins or other pin-like devices 29 and 30 (shown sectioned) to connector 31 and strut 27 in the usual manner of the prior art. For the purposes of discussion, pins and pin-like devices will be considered to be interchangeable throughout this patent application. Similarly, force transmitting connectors may be of simple solid design or composed of a multitude of components, some of which may be movable within an assembly.

Stabilizer 32 is connected by means of pins 33 and 34 to connector 31 and strut 27. The alignment between brake shoe 35 and wheel 36 is now controlled by a four bar linkage comprising the connected combination of strut 27, lever 28, connector 31 and stabilizer 32. This alignment is maintained because strut 27 and connector 31 are held in a parallel relationship regardless of the angularity of lever 28 or stabilizer 32.

This assembly of components provides a resistance against the generated brake torque when brake shoe 35 is forced into wheel 36 during braking operations. In the present invention, end guide 21 of brake beam assembly 23 is now positioned in a generally parallel manner to lower surface 25 of wear liner 24 (visible in the cut-out areas of brake head 22 and brake shoe 35). Corner wear and resulting misalignment of the prior art components is minimized, as is their usual progressive deterioration with time. Brake shoe 35 now wears approximately evenly from top to bottom.

The components shown in FIG. 2 comprise one half of a simple brake arrangement in one truck of a Railway car. The other half is a mirror image of similar parts connected to the right end of connector 31 and partially represented in FIG. 3. Connector 31 may be one piece or it may be a self adjusting connector 31*a*.

Figure 3:
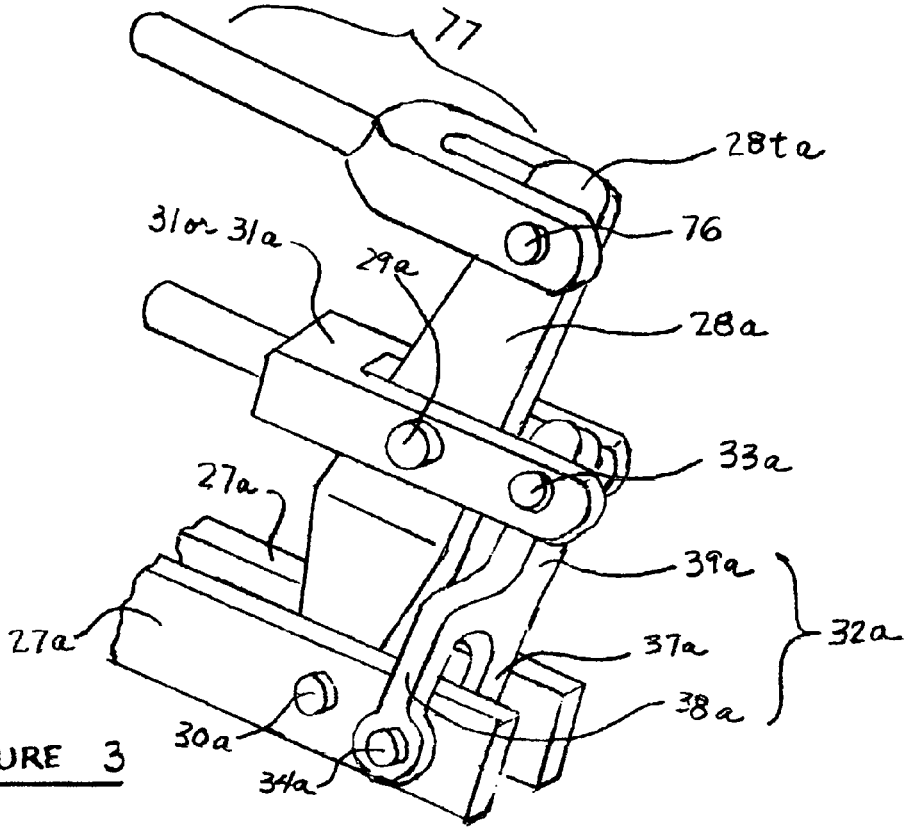
FIG. 3. is a perspective view of a Brake Beam stabilizer Assembly of the present invention installed in a Railway car brake system showing the connections with the brake beam strut, a lever and having a connector positioned above the brake beam strut.

Another feature of the present invention is demonstrated in FIG. 3. The right end of force transmitting member 31 is connected by means of pins 29*a* and 33*a* to lever 28*a* and stabilizer 32*a*. The lower ends of lever 28*a* and stabilizer 32*a* are connected to strut 27*a* by pins 30*a* and 34*a* in a manner similar to that depicted in FIG. 2.

Stabilizer 32*a* may have two legs 37*a* and 38*a*, each connected to strut 27*a* by means of pin 34*a*. The use of two legs compared to one greatly improves the lateral stability of stabilizer 32*a* and consequently provides positive lateral support for lever 28*a* and is further discussed below. Stabilizing force members 32 and 32*a* provide lateral stability and positioning for each end of connector 31. As a result, either connector 31 or connector 31*a* provides guided support for force transmitting levers 28 and 28*a* in a manner that reduces lever binding and wear that were common in the prior art assembly. The top 28*ta* of lever 28*a* is also held in a desirable lateral orientation that facilitates its connection to top actuating bar 77 using pin 76. Top actuating bar 77 is similarly held in a desirable angular position that prevents uncontrolled contact with other parts of the railway car as often occurs in thr prior art.

In order to adapt to levers in the various brake systems having differing bends, leg 39*a* of stabilizer 32*a* may be correspondingly bent relative to leg 37*a* to accommodate a bend as in lever 28*a* between holes that receive pins 29*a* and 30*a*.

Figure 4:
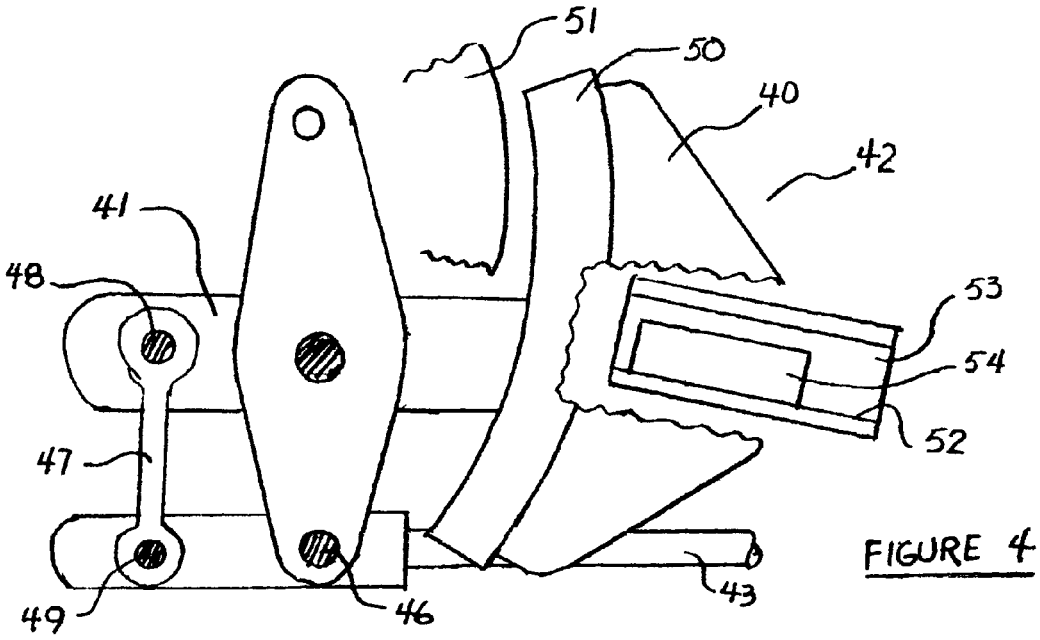
FIG. 4. is a partial elevation view of a Brake Beam Stabilizer Assembly of the present invention installed in a Railway car brake system having a connector positioned below the brake beam strut.

FIG. 4 depicts one of many alternate arrangements of the present invention.

In FIG. 4, end guide 54, brake head 40 and strut 41 are components of brake beam assembly 42. lever 44 is connected by means of pins 45 and 46 to strut 41 and connector 43 in the usual manner of the prior art. In the arrangement shown, connector 43 is positioned below strut 41.

In the present invention, stabilizer 47 is connected by means of pins 48 and 49 to strut 41 and connector 43. A four bar linkage is formed by the connected combination of strut 41, lever 44, connector 43 and stabilizer 47. This linkage, as in the other variations illustrated, controls the lateral alignment between brake shoe 50 and wheel 51 to prevent unwanted wear of wheel flanges.

This assembly of components provides similar resistance against the generated brake torque when brake shoe 50 is forced into wheel 51 during braking operations, compared to the results achieved with the components shown in FIG. 3. In this variation of the present invention, end guide 54 is positioned in a generally parallel manner to lower surface 52 of wear liner 53 (visible in the cut-out areas of brake head 40 and brake shoe 50). Corner wear and resulting misalignment of the prior art components is also avoided when connector 43 is arranged below strut 41. Brake shoe 50 wears approximately evenly from top to bottom as well.

The details of the stabilizer of the present invention shown in FIGS. 5 *a* and 5*b* are not meant to be exhaustive of the possibilities. A person skilled in the art of design or fabrication, for example, may be able to provide further variations of the concept.

Figure 5A:
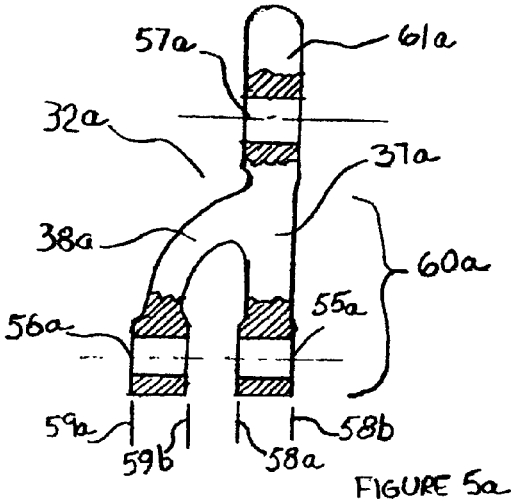
FIGS. 5*a* through 5*d* show details of arrangements of the stabilizer member of the present invention.
Figure 5B:
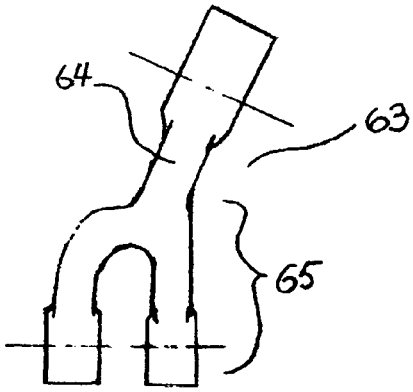

In FIG. 5*a*, stabilizer 32*a* has a jaw end 60*a* comprised of central leg 37*a* and outer leg 38*a*. Hole 55*a* is located between surfaces 58*a* and 58*b* on inner leg 37*a*. Hole 56*a* is located between surfaces 59*a* and 59*b* on outer leg 38*a*. For practical purposes, holes 55*a* and 56*a* are co-cylindrical in order to accept pin 34*a* shown and described in FIG. 3. Leg 61*a* may be bent with respect to the axis of central leg 37*a* as shown in FIG. 5*b* and accommodates hole 57*a*.

Figure 5C:
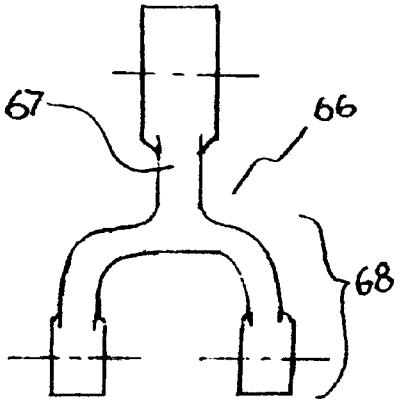

In FIG. 5*c*. connector end 67 is not aligned with either arm in jaw end 68 of stabilizer 66. For simplicity, holes are not shown.

Figure 5D:
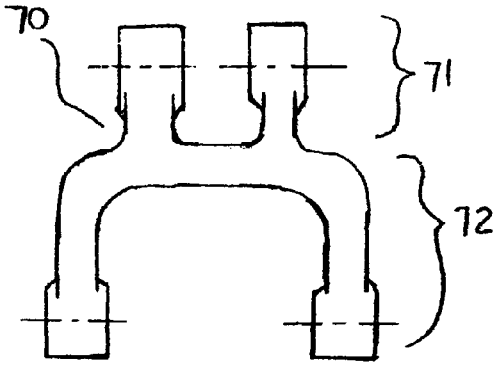

In FIG. 5*d*. connector end 71 and jaw end 72 of stabilizer 70 are both bifurcated. For simplicity, holes are not shown.

I claim:

1. A brake system in a railway vehicle truck comprising:

A. Two brake beams supported within primary supports that position and forcefully apply brake shoes at a controlled angular orientation relative to each of four wheels in order to cause a brake application;

B. applied brake force elements including two levers, a connector, a plurality of pins and a top actuating bar to work in conjunction with said brake beams to convey braking forces to said brake shoes;

C. two stabilizing members pivotably appended between said applied brake force elements to effect an application of said brake shoes at a controlled angular orientation relative to wheel treads whereby said brake shoes will be aligned evenly with said wheel treads;

said brake beams are supported by end guides within wear liners, and react braking torque by means of said end guides acting against said wear liners, said stabilizing members pivotably connected between a strut of said brake beam and a connector, in combination with a lever to form a four bar linkage, whereby such linkage will orient said end guides within said wear liners to reduce friction and wear.

2. A brake system in a railway vehicle truck as in claim 1 having one or more stabilizing members each having an extended bar at one end, capable of receiving holes of various spacing to correspond with the hole spacing of an associated lever(s), being bifurcated at the other, and connected between a brake beam strut and a connector, wherein said bifurcated end is pivotably attached to the strut of a brake beam.

3. A stabilizing member as in claim 2 having a bend near the junction of the two ends.

4. A brake system in a railway vehicle truck as in claim 1 having a brake beam with a strut having a set of holes to receive a pin to connect a lever, a second set of holes to receive a pin to connect a stabilizing member, whereby the bifurcated end of said stabilizing member may be pivotably attached.

5. A brake system in a railway vehicle truck as in claim 1, having a connector, having two sets of holes to receive pins to connect levers, one or more sets of holes to receive pins to connect one or more stabilizing members, whereby an extended bar end of each said stabilizing member may be pivotably attached.

6. A brake system in a railway vehicle truck as in claim 1, having a connector of complex construction that may provide for self adjustment of the brake rigging, said connector having two sets of-holes to receive pins to connect levers, one or more sets of holes to receive pins to connect one or more stabilizing members, whereby an extended bar end of each said stabilizing member may be pivotably attached.

* * * * *